United States Patent [19]

Walker et al.

[11] 4,150,557

[45] Apr. 24, 1979

[54] FORGING APPARATUS HAVING MEANS FOR RADIALLY MOVING BLADE DIE SEGMENTS

[75] Inventors: Bryant H. Walker, Stuart; Ralph B. Bogard, North Palm Beach, both of Fla.

[73] Assignee: United Technologies Corporation, Hartford, Conn.

[21] Appl. No.: 860,517

[22] Filed: Dec. 14, 1977

[51] Int. Cl.[2] ..... B21K 1/32

[52] U.S. Cl. ..... 72/354; 29/159 R; 29/156.8 B; 72/403

[58] Field of Search ..... 72/353, 354, 357, 358, 72/359, 360; 29/159 R, 159.1, 159.2, 159.01

[56] References Cited

U.S. PATENT DOCUMENTS

| | | | |
|---|---|---|---|
| 2,744,426 | 5/1956 | Lyon | 72/354 |
| 2,826,161 | 3/1958 | Palmer | 72/354 X |
| 3,298,218 | 1/1967 | Gollwitzer | 29/159.1 |
| 3,750,450 | 8/1973 | Sharp et al. | 72/353 |
| 3,935,627 | 2/1976 | Wolbert | 29/159 R |
| 4,074,559 | 2/1978 | Beane et al. | 29/159 R |

*Primary Examiner*—Leon Gilden

*Attorney, Agent, or Firm*—Jack N. McCarthy

[57] ABSTRACT

A forging apparatus has an upper die and lower die with the lower die being positioned on a die stack with the upper die being movable by a ram, said upper and lower dies having cylindrical portions extending towards each other where the rim of the formed disc is to be located. Blade dies are positioned around the radial opening presented between the two faces of the upper and lower die as they rest on a preformed blank, said cylindrical array of blade dies being held in position by two wires around their outer circumference and supported in the forging operation by a cylindrical back-up die; the cylindrical array of blade dies being slanted outwardly at its upper and lower edge from where they engage the cylindrical portions, forming an upper and lower annular cam surface. Ring members are positioned around both of said cylindrical sections for slidable movement thereon, said ring members being of wedge-shape cross-section so that as they are moved inwardly, when they contact said cam surfaces, they will cam said blade dies radially outward. Actuating pins extend from each of said ring members to a location above and below their respective upper and lower dies where they can be actuated by spider arms fixed to an actuating shaft which extends through their respective ram or die stack. Knockout pins are located in the upper and lower dies and are actuated by rods extending through each of the actuating shafts.

7 Claims, 1 Drawing Figure

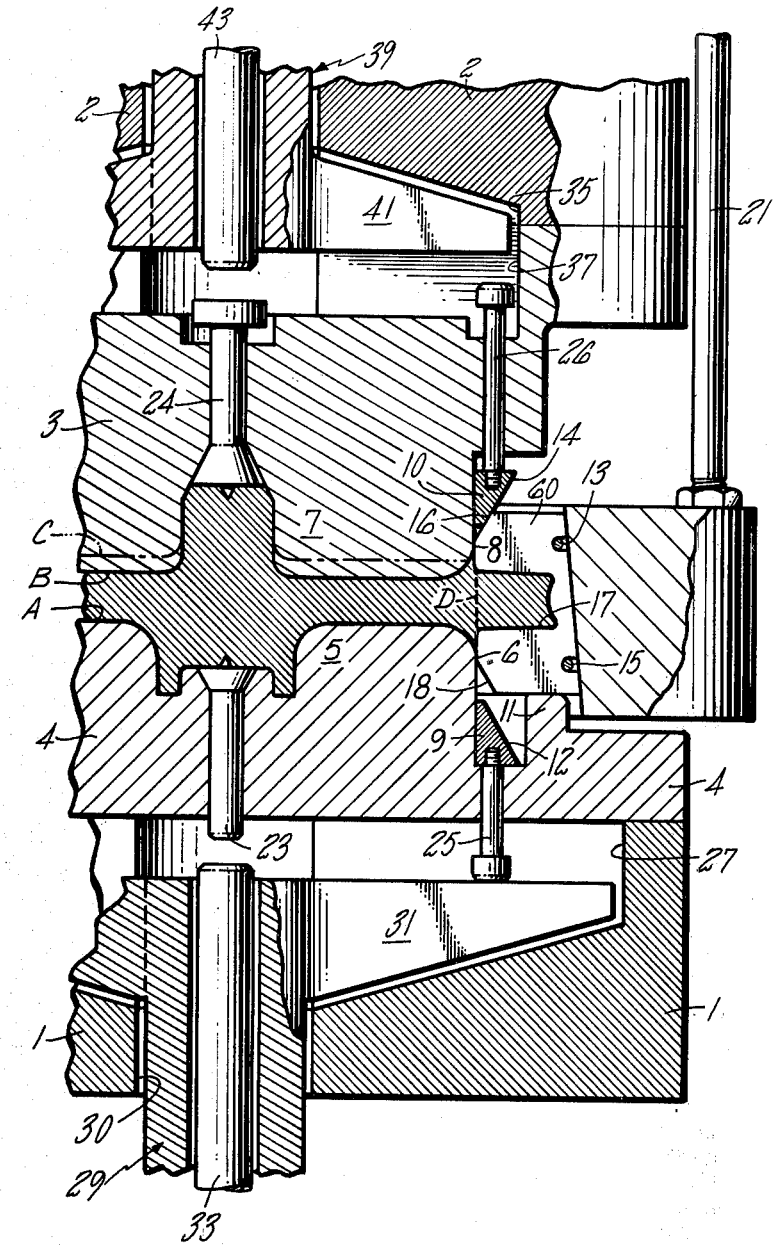
43
39
2
2
41
35
21
37
26
24
3
14
10
60
13
16
7
8
C
B
A
D
17
5
6
15
18
11
9
12
4
4
23
25
27
31
1
1
30
29
33

FORGING APPARATUS HAVING MEANS FOR RADIALLY MOVING BLADE DIE SEGMENTS

BACKGROUND OF THE INVENTION

This invention relates to an apparatus and method of forming a disc with integral blades including a plurality of blade dies positioned around a radial opening between an upper and lower die so that the upper and lower die can further press a preformed disc blank into a finished disc and outwardly into said blade dies. An apparatus for making a disc with integral blades is disclosed in U.S. Pat. No. 3,122,823 and in U.S. Pat. No. 4,051,708. However, the apparatus disclosed in these patents does not have means for moving the blade dies radially outwardly after the final forming to prevent any mechanical interference between the forged blades and blade dies during the cooldown period as a result of thermal contraction of the die and forged part. U.S. Pat. No. 4,040,161 discloses a separate tool which can move rim blade dies radially outwardly.

SUMMARY OF THE INVENTION

A primary object of the present invention is to provide an apparatus for forming a disc with integral blades and providing for movement radially outward of the blade dies prior to the cooldown period.

Another object of the invention is to provide a forging apparatus wherein said upper die and lower die are provided with ring members of wedge-shape cross-section which can be forced toward each other and against an annular inclined cam surface on the top and bottom of a ring of blade dies to force them radially outward from said formed blades.

Another object of the invention is to provide a forging apparatus having controls independent of the knockout pins to contact actuating rods fixed to each ring member of wedge-shape cross-section.

BRIEF DESCRIPTION OF THE DRAWINGS

The FIGURE is a side view partially in cross-section of a portion of a forging apparatus showing the preformed part pressed into the final shape of a disc and blades with ring members of wedge-shape cross-section being positioned so that they can be moved axially toward each other to force the blade dies radially outward.

DESCRIPTION OF THE PREFERRED EMBODIMENT

As shown in the FIGURE, the forging apparatus includes a bed 1 onto which a lower die 4 is fixed and a ram 2 on which an upper die 3 is fixed. The lower die 4 has a flat lower surface with the upper surface having an upwardly projecting center portion 5 having a cylindrical outer surface 6. Said center portion 5 has its projecting end A contoured to the finished configuration of one side of a finished disc. The upper die 3 has a recess 37 in its upper surface, for a purpose to be hereinafter described, with the lower surface having a downwardly projecting center portion 7 having a cylindrical outer surface 8, said cylindrical outer surfaces 6 and 8 being axially aligned and having the same radius from the center of the upper and lower dies 3 and 4. Said center portion 7 has its projecting end B contoured to the finished configuration of the other side of a finished disc.

The cylindrical outer surface 6 has a ring member 9 positioned therearound having a wedge-shape cross-section with the slanted surface 12 thereof tapering outwardly as it extends downwardly with ring member 9 being mounted for slidable movement thereon. The cylindrical outer surface 8 has a ring member 10 positioned therearound having a wedge-shape cross-section with the slanted surface 14 thereof tapering outwardly as it extends upwardly with ring member 10 being mounted for slidable movement thereon. An annular flange 11 extends upwardly from said lower die 4 adjacent the ring member 9, providing a bottom locating means for a cylindrical array of blade dies 60 held together by two wires 13 and 15 fixed in grooves located around the top and bottom of the outer surface thereof.

The upper die 3 is shown in its lowest position since the preformed part has been pressed into the final shape of a disc and blades. The phantom line C shows a top line of the preformed part before the upper and lower dies were brought into the positions shown in the FIGURE, where the cylindrical array of blade dies 60 has the blade cavities 17 of the blade dies 60 filled to form blade shapes.

The cylindrical array of blade dies 60 is positioned on the annular flange 11 with the top and bottom inner surfaces above and below the blade cavities 17 engaging the cylindrical surfaces 8 and 6, respectively. Each of the blade dies 60 being slanted outwardly at 16 and 18 at the uppermost and lowermost portion, respectively, from where they engage the cylindrical surfaces 8 and 6, respectively. It can be seen that the slanted portions 16 and 18 of each of the blade dies 60 form two annular slanted surfaces when placed in a cylindrical array. A back-up ring 19 is positioned around the outer surface of the cylindrical array of blade dies 60 for supporting them during the forging operation. It is noted that the back-up ring has a mating tapered surface engagement with the outer wall of the cylindrical array of blade dies 60 to insure positive engagement. The tapered surface cams the blade dies 60 inwardly. The back-up ring 19 is raised and lowered by connecting rods 21.

The lower die 4 has a knockout pin 23 located therein for pushing the finally formed disc and blades upwardly from the projecting end A of the center portion 5. The knockout pin 23 projects below the flat lower surface of the lower die 4. A plurality of equally spaced rods 25 are attached to the bottom of the ring member 9 and each rod 25 extends through an opening in the lower die 4 below the flat lower surface thereof. The top of the bed 1 has a recess 27 therein which is formed having an open center 30 with radially extending grooves to receive the head of an actuating member 29 which has a plurality of radially extending arms 31. Each radially extending groove is aligned with one of the actuating rods 25 so that movement upwardly of actuating member 29 by a hollow shaft extending through the open center 30 of bed 1 will move the ring member 9 upwardly so that its slanted surface 12 can engage the annular slanted surface formed by the slanted portions 18 of the blade dies 60. An actuating rod 33 extends through the hollow shaft of actuating member 29 to push the lower end of knockout pin 23 when desired.

The bottom of the ram 2 has a recess 35 which mates with the recess 37 of the top of the upper die 3, said recesses 35 and 37 being formed having an open center with a plurality of radially extending matching grooves. The upper die 3 has a knockout pin 24 located therein for pushing the finally formed disc and blades downwardly from the projecting end B of the center portion 7 of the upper die 3. The knockout pin 24 projects into the open center of the recess 37 in the top surface of the upper die 3. A plurality of equally spaced rods 26 are attached to the top of the ring member 10 and each rod 26 extends through an opening in the upper die 3 into one of the radially extending grooves of the recess 37 in the top surface of the upper die 3. The recesses 35 and 37 receive the head of an actuating member 39 which has a plurality of radially extending arms 41. Each radially extending arm 41 is aligned with one of the actuating rods 26 so that movement downwardly of the actuating member 39 by a hollow shaft extending through the open center of the ram 2 will move the ring member downwardly so that the slanted surface 14 can be forced against the annular slanted surface formed by the slanted portions 16 of the blade dies 60. An actuating rod 43 extends through the hollow shaft of actuating member 39 to engage the knockout pin 24 when desired. The moving force for the actuating rods referred to above can be those normally used in the forging and press equipment, such as hydraulic rams.

In operation, a preformed disc blank is heated in a furnace along with a cylindrical array of blade dies 60 held together by two wires 13 and 15; with the ram 2 and upper die 3 pulled up out of the way along with a back-up ring 19, the preformed disc blank is placed on the lower die with the outer edge extending substantially to the dotted line D and with the upper face substantially on the phantom line C; the cylindrical array of blade dies 60 is then placed around the preformed disc blank with the lower inner surface of the blade dies engaging cylindrical surface 6 and resting on the annular flange 11; the back-up ring 19 is then brought down along with the ram 2 and upper die 3. The lower surface of the upper die 3 is first brought into contact with the preformed disc blank with the cylindrical surface 8 engaging the upper inner surface of the cylindrical array of blade dies 60; with the upper die ready to move downwardly to finally force the preformed disc blank into a finally formed disc with blades, the back-up ring 19 is moved into place to support the cylindrical array of blade dies 60. As is well known in the art, the upper and lower dies 3 and 4, respectively, can be preheated with controlled heating during the pressing by means shown in the prior art. One patent showing such an apparatus is U.S. Pat. No. 3,698,219.

After the completion of the forging, finally forming the disc with integral blades, the blade cavities 17 of the cylindrical array of blade discs 60 are filled (see the FIGURE); the back-up ring 19 is raised upwardly to where the top thereof is adjacent the portion of the upper die 3 located thereover. The actuating members 29 and 39 are then moved until the slanted surfaces 12 and 14 contact the two annular slanted surfaces formed by the slanted portions 16 and 18 of each of the blade dies 60. At this time, both actuating members 29 and 39 are moved to apply equal forces to the rods 25 and 26, respectively, moving the ring members 9 and 10 towards each other, camming the blade dies 60 radially outward. This force permanently stretches the wires 13 and 15; with the blade dies loose from the forging, the actuating members 29 and 39 are moved outwardly to remove force from the ring members 9 and 10; the upper die is then moved upwardly with the upper rod 43 positioned against the knockout pin 24 to keep the finished forging in the lower die 4; after the upper die 3 has been moved out of the way along with the back-up ring 19, the actuating rod 33 pushes the lower knockout pin 23 upwardly forcing the finished disc with integral blades and now loose ring of blade dies 60 away from the lower die 4. The finally forged disc and blades with the loose ring of blade dies 60 is picked up and placed where desired for cooldown. The next preheated preformed disc blank is placed onto the lower die 4 and the next preheated cylindrical array of blade dies 60 held together by two wires 13 and 15 is placed in position on the annular flange 11 and the upper die 3 closed on the preformed preheated disc blank. After temperature stabilization, the next forging cycle can begin.

We claim:

1. A forging apparatus having an upper die and a lower die, said upper die having a first finished disc shape on its outer end, said lower die having a second finished disc shape on its outer end, said outer ends of said upper and lower dies being spaced from each other, a cylindrical array of blade dies being positioned around the space between the outer end of said upper die and the outer end of said lower die, said cylindrical array of blade dies having an inner surface contacting said upper die and said lower die, said cylindrical array of blade dies having an outer surface, a back-up ring movable between a position spaced from said cylindrical array of blade dies to a position against said outer surface of said cylindrical array of blade dies, a first cam means located around said upper die, second cam means located around said lower die, said cylindrical array of blade dies having third cam means, said first and second cam means on said upper die and lower die being movable to engage said third cam means and move said blade dies outwardly when said back-up ring is spaced from said outer surface of said cylindrical array of blade dies.

2. A forging apparatus as set forth in claim 1 wherein said first cam means has a downwardly facing cam surface, said second cam means has an upwardly facing cam surface, said third cam means has an upwardly facing cam surface on the top of said cylindrical array of blade dies and a downwardly facing cam surface on the bottom thereof, said downwardly facing cam surface of said first cam means being engageable with said upwardly facing cam surface on said third cam means and said upwardly facing cam surface of said second cam means being engageable with said downwardly facing cam surface of said third cam means to move said blade dies outwardly when said back-up ring is spaced from said outer surface of said cylindrical array of blade dies.

3. A forging apparatus as set forth in claim 1 wherein said cylindrical array of blade dies comprises a plurality of blade dies held in a cylindrical shape.

4. A forging apparatus as set forth in claim 3 wherein said plurality of blade dies are held in a cylindrical array by wire means positioned around the outer surface thereof.

5. A forging apparatus having an upper die and a lower die, said upper die having a downwardly projecting center portion, said downwardly projecting center portion having a first outer cylindrical surface therearound with a first finished disc shape on its outer end, said lower die having an upwardly projecting center portion, said upwardly projecting center portion having a second outer cylindrical surface therearound with a second finished disc shape on its outer end, said outer end of said downwardly projecting center portion being spaced from the outer end of said upwardly projecting center portion, a first ring member being mounted for movement on said first outer cylindrical surface, a second ring member being mounted for movement on said second outer cylindrical surface, a cylindrical array of blade dies being positioned around the space between the outer end of said downwardly projecting center portion and the outer end of said upwardly projecting center portion, said cylindrical array of blade dies having an inner surface contacting said first outer cylindrical surface and said second outer cylindrical surface, said cylindrical array of blade dies having an outer surface, a back-up ring movable between a position spaced from said cylindrical array of blade dies to a position against said outer surface of said cylindrical array of blade dies, said first ring member being positioned above said cylindrical array of blade dies, said second ring member being positioned below said cylindrical array of blade dies, said upper part of said cylindrical array of blade dies having a first cam surface, said lower part of said cylindrical array of blade dies having a second cam surface, said first ring member having a third cam surface, said second ring member having a fourth cam surface, said first and second ring members being movable towards each other to have the third cam surface engage said first cam surface and said fourth cam surface engage said second cam surface and move said blade dies outwardly when said back-up ring is spaced from said outer surface of said cylindrical array of blade dies.

6. A forging apparatus as set forth in claim 1 wherein said first cam surface is located on the upper inner surface of said cylindrical array of blade dies, said second cam surface is located on the lower inner surface of said cylindrical array of blade dies, a first cylindrical surface positioned around said upper die, a second cylindrical surface positioned around said lower die, a first ring member having a first inner cylindrical surface for movement over said first cylindrical surface, said first ring member being of wedge-shape cross-section with the outer surface of the first ring member having a slanted surface facing downwardly to form a third cam surface for engaging said first cam surface, a second ring member having a second inner cylindrical surface for movement over said second cylindrical surface, said second ring member being of wedge-shape cross-section with the outer surface of the second ring member having a slanted surface facing upwardly to form a fourth cam surface for engaging said second cam surface.

7. A combination as set forth in claim 1 wherein said first ring member has an upstanding annular flange located outwardly thereof providing a stop for said cylindrical array of blade dies.

* * * * *